United States Patent [19]

Shimojo et al.

[11] 4,136,301

[45] Jan. 23, 1979

[54] SPARK PLUG IGNITER COMPRISING A DC-DC CONVERTER

[75] Inventors: Hirokazu Shimojo, Akatsukashin; Toshio Inamura, Tokyo, both of Japan

[73] Assignee: Kabushiki Kaisha Sigma Electronics Planning, Japan

[21] Appl. No.: 757,516

[22] Filed: Jan. 7, 1977

[30] Foreign Application Priority Data

Jul. 26, 1976 [JP] Japan ..... 51/88276

[51] Int. Cl.[2] ..... H05B 37/02; H05B 39/04; H05B 41/36

[52] U.S. Cl. ..... 315/209 T; 123/148 E; 331/113 A; 315/166; 315/176; 315/172; 315/209 R

[58] Field of Search ..... 315/209 R, 209 CD, 209 T, 315/176, 167, 166, 170, 171, 172; 331/113 A; 123/148 E, 148 DC; 361/253, 263

[56] References Cited

U.S. PATENT DOCUMENTS

| | | | |
|---|---|---|---|
| 3,206,694 | 9/1965 | Bates | 331/113 A |
| 3,906,919 | 9/1975 | Asik et al. | 315/209 CD |
| 3,919,993 | 11/1975 | Neuman | 123/148 E |
| 3,972,315 | 8/1976 | Munden et al. | 123/148 E |
| 4,033,316 | 7/1977 | Birchenough | 315/176 |

*Primary Examiner*—Saxfield Chatmon, Jr.
*Attorney, Agent, or Firm*—Robert E. Burns; Emmanuel J. Lobato; Bruce L. Adams

[57] ABSTRACT

A spark plug igniter with an auxiliary power source, in which the auxiliary power source is a DC-DC converter including a feedback loop. A high voltage induced in a secondary winding of an ignition coil and a DC voltage generated by the converter are additionally supplied in the same polarity to a spark discharge gap. The feedback loop of the DC-DC converter comprises a feedback winding, a rectifier connected to the feedback winding through a reactance element, and means for connecting the DC output of the rectifier in series to the DC power source of the converter in the same polarity.

5 Claims, 10 Drawing Figures

SPARK PLUG IGNITER COMPRISING A DC-DC CONVERTER

BACKGROUND OF THE INVENTION

This invention relates to a spark plug igniter for intermittently firing a spark-discharge device, such as a spark plug in an internal combustion engine of an automobile and, more particularly, to the spark plug igniter provided with an ignition coil having a secondary winding connected in series to an auxiliary DC source so as to increase the effective ignition energy for minimizing the rate of miss-firing.

It has been known that an electrical spark in an internal combusion engine is a composite spark formed by a capacity spark discharge and a subsequent inductance spark discharge. In the capacity spark discharge, a large current flows for an extremely short duration with the result that the electromagnetic energy stored in the ignition coil is instantaneously discharged at a spark gap. However, in the inductance spark discharge which takes place immediately after the capacity spark discharge, a small current flows for a relatively long period determined by the self- and/or mutual-inductance of the ignition coil. Accordingly, the capacity spark discharge is closely related to the miss-firing ratio, while the inductance spark discharge to the capability of ignition.

In the conventional spark plug igniter, since the above-mentioned two kinds of discharges are actuated only by a high voltage induced across the secondary winding of the ignition coil, independent control or emphasis of the individual discharge is impossible. Accordingly, a proposal has been made in which an auxiliary DC or AC source is incorporated in series to the secondary winding of the ignition coil in such a manner that the voltage for inductance discharge is raised to increase the ignition energy. As a result of this construction, the miss-firing of the igniter is decreased to some extent, and better combusion of fuel is realized to improve the specific fuel consumption and to reduce harmful gas exhaustion. A constant voltage source with a low internal impedance is usually used as the auxiliary current source. In the igniter provided with such an auxiliary current source, the duration of an inductance spark discharge is extended as the output voltage of the auxiliary current source is increased. However, the igniter has the following disadvantages:

(1) If the voltage of the auxiliary current source is maintained at a constant value, the spark intensifying effect depends upon the number of revolutions of the engine, namely, the effect is reduced as the number of revolutions increases. Therefore, a voltage determined to obtain the sufficient spark intensity in a range of high number of revolutions (i.e. a high speed operation) becomes too high in a range of lower number of revolutions (i.e. a low speed operation), and results in (a) unstable sparking, (b) insufficient spark extinction, and (c) continuous spark. From this point of view, the source voltage must be determined to allow the low speed operation. However, the voltage so determined will not provide the satisfactory spark intensifying effect in the higher speed operation.

(2) If the auxiliary current source is constructed to have a constant voltage, the spark intensifying effect depends on the size of a plug gap. Since the spark intensifying effect decreases with increasing plug gap under a given number of revolutions of the engine, if the voltage is established at such point that the sufficient spark intensifying effect is obtained for a large plug gap, this voltage becomes too high for a small plug gap and causes the unfavorable result stated in the above item (1). Moreover, the gaps of the conventional plugs do not always have the same size and are destined to increase as the plugs wear, so that the voltage should be determined for a plug having a small gap or a new one. Accordingly, it cannot be expected to obtain the satisfactory spark intensifying effect in a case where the plug gap is widened.

SUMMARY OF THE INVENTION

An object of this invention is to provide a spark plug igniter having an auxiliary power source to develope a high internal source impedance of high output voltage for a light load and a low internal source impedance of low output voltage for a heavy load thereby to remove the above mentioned defects of conventional ones.

In accordance with this invention, there is provided a spark plug igniter with an auxiliary power source of a DC-DC converter including a feedback loop. A high voltage induced in a secondary winding of an ignition coil and a DC voltage generated by the converter are additionally supplied in the same polarity to a spark discharge gap. The feedback loop of the DC-DC converter comprises a feedback winding, a rectifier connected to the feedback winding through a reactance element, and means for connecting the DC output of the rectifier in series to the DC power source of the converter in the same polarity.

BRIEF DESCRIPTION OF THE DRAWINGS

The principle, construction and operation of this invention will be clearly understood from the following detailed description taken in conjunction with the accompanying drawings, in which.

DESCRIPTION OF THE PREFERRED EMBODIMENTS

Figure 1:
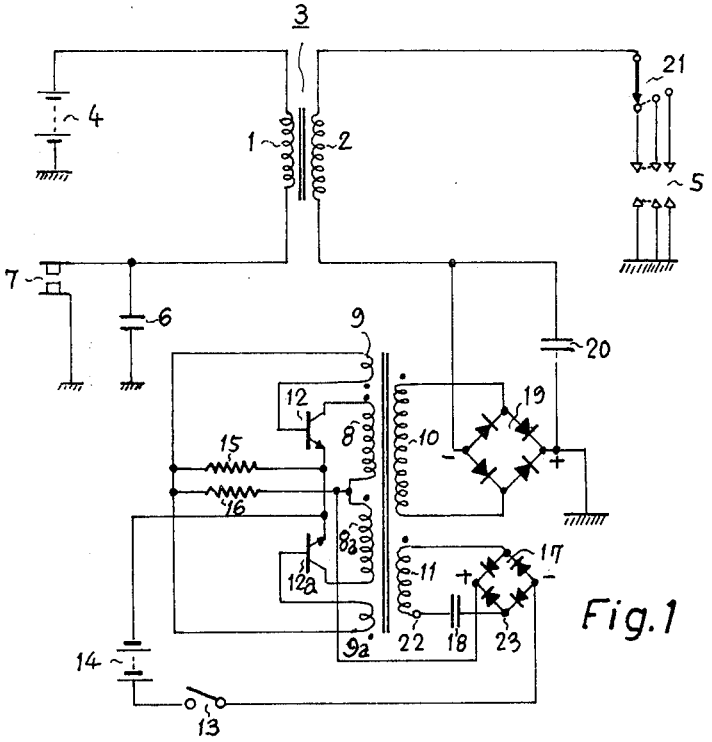
FIG. 1 is a circuit diagram illustrating an embodiment of this invention.

A circuit of an embodiment of this invention shown in FIG. 1 comprises, an ignition coil 3 with a primary winding 1 and a secondary winding 2, a DC source 4 supplying a current to the primary winding 1, spark gaps 5 to which a high voltage induced across the secondary winding 2 is applied through a distributor 21, a capacitor 6 connected in series to the primary winding 1, a breaker point 7 connected in parallel with the capacitor 6, and a DC-DC converter. This DC-DC converter is formed by primary windings 8 are 8*a*, secondary windings 9 and 9*a*, an output winding 10, a feedback winding 11, transistors 12 and 12*a* each having a collector connected to each one terminal of the primary winding 8 or 8*a*, a base connected to each one terminal of the secondary winding 9 or 9*a* and an emitter commonly connected to a DC power source 14 of the converter, a resistor 15 connected between the emitters and a point to which the other terminals of the secondary windings 9 and 9a are commonly connected, a resistor 16 connected between the above connection point of the secondary windings 9 and 9a and a common connection point of the primary windings 8 and 8a, rectifiers 17 with a pair of input terminals connected across the feedback winding 11 and a pair of DC output terminals respectively connected to the common connection point of the windings 8 and 8a and the source 14 through a safety switch 13 in such a manner that the currents are mutually added, a reactance element or reactor 18 (e.g. a capacitor in FIG. 1) connected in series between the feedback winding 11 and the rectifiers 17, output rectifiers 19 with input terminals connected across the output winding 10 and output terminals connected in series to the secondary winding 2 of the ignition coil 3, and a smoothing capacitor 20 connected across the output of the rectifiers 19.

It is apparent that the DC-DC converter of this embodiment is characterized by the feedback winding 11, associated circuit elements and wirings, while other parts are substantially the same as those in conventional ones.

When the engine starts, the negative pressure produced in the engine closes the safety switch 13 to make either the transistor 12 or 12a conductive as mentioned below. If the transistor 12 is made conductive, a primary current from the battery 14 flows through the safety switch 13, the rectifiers 17, the primary winding 8 and the collector-emitter path of the transistor 12, so that voltages are induced across the secondary windings 9 and 9a. The induced voltage across the winding 9 biases the transistor 12 in the forward direction, while the voltage across the winding 9a biases the transistor 12a in the backward direction. With this biasing, a positive feedback loop suddenly saturates the transistor 12. The current in the primary winding 8 excites the iron core and, when the magnetic flux density saturates in the core, no voltage appeares across the secondary winding 9. In such a condition, the transistor 12 has no base current so that the collector-emitter path thereof is cut-off. The magnetic flux in the core then begins to decrease and the increasing reverse voltages are induced across the secondary windings 9 and 9a, providing the forward bias for the transistor 12a. The primary current then flows in a loop including the power source 14, the switch 13, the rectifiers 17, the primary winding 8a and the transistor 12a, so that a positive feedback circuit similar to that mentioned above is established to saturate the transistor 12a. The excitation of the core increases until the magnetic flux density is saturated at the reverse direction. In this manner, the two transistors 12 and 12a are alternatively become conductive, so that an alternating current voltage of rectangular form is induced across the output winding 10. The alternating current voltage is rectified by the output rectifiers 19 and serially added to the high voltage across the secondary winding 2 of the ignition coil 3. On the other hand, an alternating current of rectangular waveform generated at the feedback winding 11 is fed through the capacitor 18 to the rectifiers 17, which provides a DC output voltage to be added to the voltage of the source 14 at the same polarity.

Figure 2:
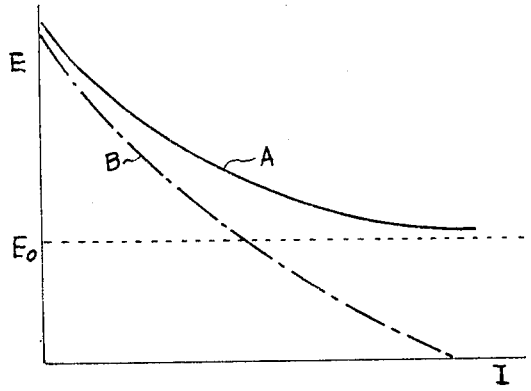
FIG. 2 shows characteristic curves illustrating voltage-current relationships of the DC-DC converter section in FIG. 1.

A curve shown in FIG. 2 shows the voltage-current relationship of the DC-DC converter of FIG. 1. As shown by curve A in FIG. 2, the increase of the load current I causes decrease of the output DC voltage E toward a given value $E_o$, which is almost equivalent to the output DC voltage of the DC-DC converter after eliminating the feedback winding 11. For the convenience of comparison, curve B illustrates the output DC voltage vis the current load relationship of a converter having an AC feedback loop while eliminating the capacitor 18 and the rectifiers 17 connected to the feedback winding 11.

As understood from the above description, the DC-DC converter to be used in the present invention has a drooping characteristic, in which the voltage suddenly decreases with increasing load current. At the beginning of the discharge at the spark gap 5, the voltage generated by the DC-DC converter is superposed on the high voltage induced across the secondary winding 2 of the ignition coil 3 to provide a sufficiently high voltage, and the resultant high voltage is fed to the gap 5 to ensure the firing there. This results in the ignitability of the spark plug 5 being increased. When the discharge once starts at the spark gap 5, the voltage across the gap 5 decreases suddenly as the discharge current increases, so that the spark charge at the gap 5 is stabilized. Moreover, the auxiliary source of DC-DC converter with a feedback function increases the magnitude and duration of the discharge current and therefore ensures extinction of discharge (i.e. breaking the current) at closure of the breaker point 7.

Figure 3A:
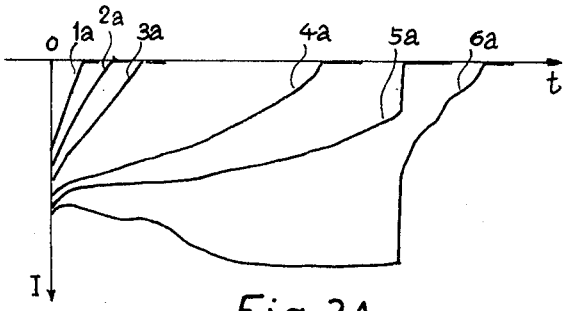
FIGS. 3A, 3B, 4A, 4B, 5A and 5B are waveform diagrams showing discharge currents supplied to a spark gap in the spark igniter of this invention and the prior art.
Figure 3B:
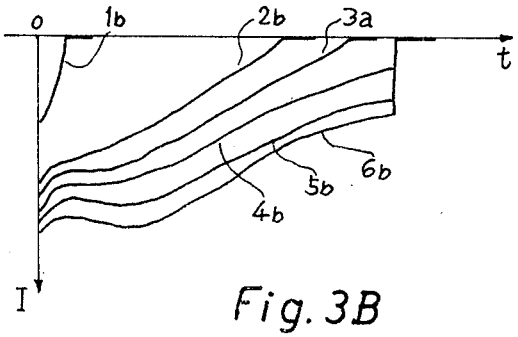
Figure 4A:
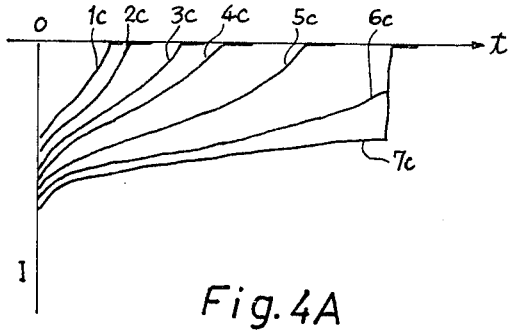
Figure 4B:
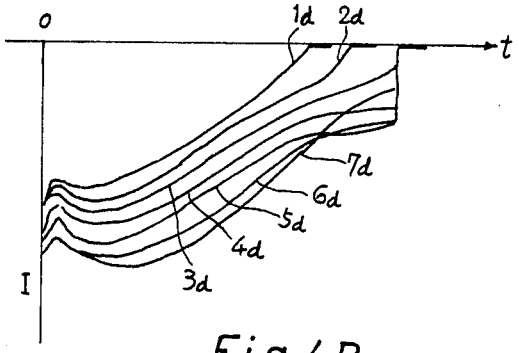

In FIGS. 3A, 3B, 4A and 4B, discharge currents produced by an ignition circuit having an auxiliary source of this invention are plotted in comparison with those produced by the circuit utilizing a conventional low impedance auxiliary source which may be obtained by rectifying the commercial alternating current. Changes of the discharge current I at the spark gap 5 in the air are plotted with the time scale t. In this case, the circuit shown in FIG. 1 is used, and values of the circuit elements are determined as follows: capacitors 18 and 20 are of 220 μF and 0.047 μF, respectively, and the number of revolutions of the engine is 2,000 RPM. FIGS. 3A and 4A were obtained from commercial AC rectification source, and FIGS. 3B and 4B were obtained from the feedback type DC-DC converter according to this invention. In FIG. 3A, the output voltage of the auxiliary source is varied from 0 (curve 1a) to 1,500 volts (curve 6a), and in FIG. 3B the output voltage of the DC-DC converter is varied from 0 (curve 1b) to 2,800 volts (curve 6b). In FIG. 3A, increase of the output voltage of the auxiliary source largely extends the spark discharge duration. At the voltage of 1,500 volts (curve 6a), the spark discharge grows with time lapse and hence it is instable. Moreover, closure of the breaker point 7 cannot perform complete extinction of the arc, and in this condition a suitable igniter cannot be obtained. Therefore, in this case, establishment of the voltage of the auxiliary source is critical and very difficult. On the contrary, in FIG. 3B all spark discharge curves have similar and stable traces within the wide voltage range of the auxiliary source, so that stable spark discharge is obtained and a perfect extinction function is realized when the breaker point 7 is closed. In the examples shown in FIGS. 4A and 4B, distances of spark gaps are distributed from 11 millimeters (curve 1c) to 5 millimeters (curve 7c), while the voltage of the auxiliary source in FIG. 4A is of 1,250 volts, and the voltage of the converter source in FIG. 4B is 12 volts. In FIG. 4A, discharge durations widely vary with their gap distances, but in FIG. 4B discharge durations vary only in a narrow limited range. In FIG. 4B, the output voltage of the DC-DC converter changes from about 3,000 volts to 2,600 volts at the beginning of discharge depending upon the gap variation.

Figure 5A:
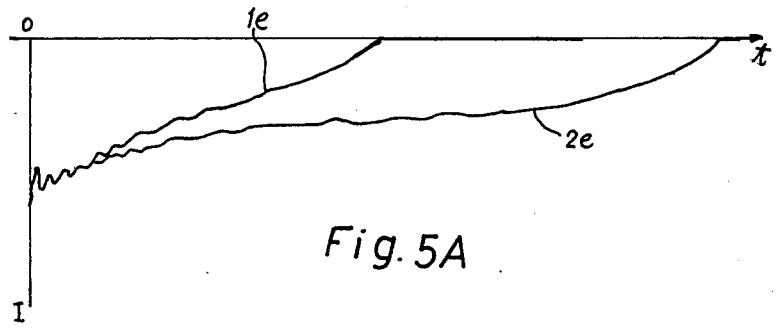
Figure 5B:
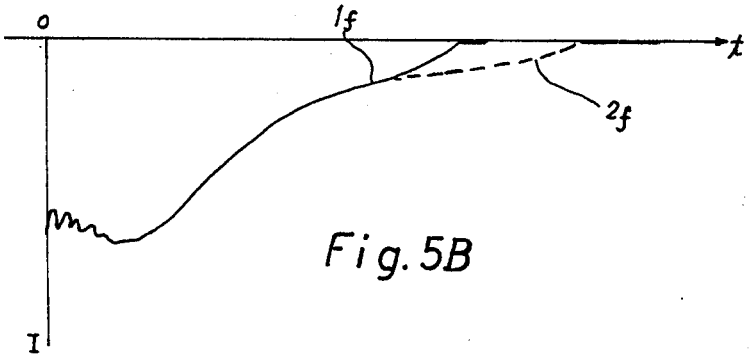

FIGS. 5A and 5B are diagrams illustrating the effect of the feedback circuit in the DC-DC converter according to this invention. The diagrams illustrate current wave forms obtained under the condition that the number of revolutions of the engine of 750 RPM, and the spark gap discharge are 10 millimeters (curves 1*e*, 1*f*) or 6 millimeters (curves 2*e*, 2*f*). In FIGS. 5A, the ordinate and the abscissa are the discharge current and the duration, respectively, and curves were obtained by an auxiliary source without any feedback loop, and the durations fluctuate to a large extent in depending on the change of gap distances. On the other hand, FIG. 5B shows those obtained by the auxiliary source with the feedback loop according to this invention, and only a little change is found in the discharge current and in the duration due to the variation of gap distance.

As understood from the above description, the auxiliary source of the present invention operates at a light load as a constant current source which provides a high output voltage and a high source impedance, but operates at a heavy load as a constant voltage source providing a low output voltage and a low impedance, which render itself most suitable for use together with such a load as a spark gap having a complex characteristic impedance. To obtain the drooping output voltage characterictic, the converter of this invention employs a reactance element and a feedback loop, while the conventional converter employes a high series resistance, and hence the converter of this invention has a smaller power consumption in comparison with the conventional one, providing a high efficiency.

Figure 6A:
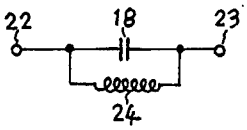
FIGS. 6A and 6B are circuit diagrams each illustrating a modification of the embodiment shown in FIG. 1.

In the above embodiments, the reactance element serially inserted in the feedback circuit may be a capacitor of the order of several hundred micro farads, which sometimes has insufficient durability because of high internal heating, and therefore a parallel connection of an inductor and a capacitor shown in FIG. 6A is more suitable for the serial reactance element. According to our test, FIGS. 3B, 4B and 5B roughly approximate the curves of the discharge currents generated by the DC-DC converter employing a reactance element formed by a parallel connection of a coil and a capacitor in a case where the values of the coil and the capacitor are of about 100$\mu$ Henrys and 0.1$\mu$ Farads, respectively. We also made a test on a rotary engine equipped with the igniter of this invention including the latter type of reactance element. This test was performed under the following conditions: The primary main jet of the carburetor was throttled to a size of 0.084 millimeters in diameter to reduce the amount of gasoline supplied while its standard value is of 0.094 milli-meters in diameter. On the other hand, the air inlet (i.e. the air bleed) is expanded to a size of 0.090 milli-meters in diameter to increase the amount of air flow while its standard value is of 0.080 millimeters in diameter. The result of the test indicates that the rotary engine had substantially the same drive-ability, durability, miss-firing and output as those of standard ones. Accordingly, the auxiliary source of the present invention can provide for operation of an engine under the lower air-fuel ratio and minimize the specific fuel consumption and harmful gas exhaustion of the engine.

Figure 6B:
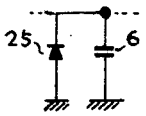

Another suitable reactance element other than the above mentioned ones is also available. Moreover, this invention can be applied to any type of igniter other than the above illustration if the trigger discharge is provided in the starting period. Furthermore, in the igniter of the type employing a breaker point as shown in FIG. 1, the breaker point can be shunted very effectively with a diode as shown in FIG. 6B.

What we claim is:

1. A spark plug igniter circuit, comprising:

an ignition coil having a primary winding and a secondary winding;

a spark discharge device connected to said secondary winding of said ignition coil for developing a discharge current therethrough and developing an electrical spark in response to a high voltage induced across said secondary winding;

a direct-current power source connected to said primary winding of said ignition coil for affecting current flow through said primary winding;

a breaker point, connected in series with said primary winding and said direct-current power source, and operative in a closed position for allowing direct current to flow through said primary winding and operative in an open position for interrupting the current flow through said primary winding to thereby induce the high voltage across said secondary winding effective for developing an electrical spark with said spark discharge device; and DC-DC converter means connected in series with said secondary winding for increasing the discharge current flowing through the spark discharge device and for extending the duration of the discharge current developed in response to the high voltage applied by said secondary winding to said spark discharge device;

wherein said DC-DC converter means comprises an auxiliary DC power source, said DC-DC converter including an input connected to said auxiliary DC power source and an output connected in series with said secondary winding and having a transformer for effecting a change between the input and the output voltage of the DC-DC converter, a feedback winding coupled with the transformer of said DC-DC converter for developing a voltage in response to current flowing through said transformer, rectifying means for rectifying the voltage induced in said feedback winding, a reactor connected in series between said feedback winding and said rectifying means, and means for connecting the output of said rectifying means in series with said auxiliary DC power source and with the same polarity to thereby vary the input voltage to said DC-DC converter according to the current flowing through said transformer of said DC-DC converter.

2. A spark plug igniter according to claim 1, in which the spark discharge device is a spark plug in an internal combusion engine.

3. A spark plug igniter according to claim 1, in which said reactor comprises a capacitor.

4. A spark plug igniter according to claim 1, in which said reactor comprises a parallel combination of a capacitor and a coil.

5. A spark plug igniter according to claim 1, further comprising a capacitor and a diode which are connected in parallel with said breaker point.

* * * * *